US010233592B2

(12) United States Patent
Nafici

(10) Patent No.: US 10,233,592 B2
(45) Date of Patent: Mar. 19, 2019

(54) METHOD FOR PROCESSING STRAW

(71) Applicant: Nafici Environmental Research, Horsham, West Sussex (GB)

(72) Inventor: Shahriar Nafici, Horsham (GB)

(73) Assignee: NAFICI ENVIRONMENTAL RESEARCH, Horsham (GB)

( * ) Notice: Subject to any disclaimer, the term of this patent is extended or adjusted under 35 U.S.C. 154(b) by 0 days.

(21) Appl. No.: 15/516,294

(22) PCT Filed: Oct. 2, 2015

(86) PCT No.: PCT/GB2015/052893
§ 371 (c)(1),
(2) Date: Mar. 31, 2017

(87) PCT Pub. No.: WO2016/051202
PCT Pub. Date: Apr. 7, 2016

(65) Prior Publication Data

US 2017/0306556 A1 Oct. 26, 2017

(30) Foreign Application Priority Data

Oct. 3, 2014 (GB) ..... 1417488.2

(51) Int. Cl.
*D21C 1/06* (2006.01)
*D21C 3/02* (2006.01)
(Continued)

(52) U.S. Cl.
CPC ..... *D21C 1/06* (2013.01); *D21C 3/02* (2013.01); *D21C 7/06* (2013.01); *D21C 7/08* (2013.01);
(Continued)

(58) Field of Classification Search
CPC . D21C 1/06; D21C 3/02; D21C 11/04; D21C 11/0007; D21C 3/26; D21C 5/005; D21C 7/08; D21H 11/12
See application file for complete search history.

(56) References Cited

U.S. PATENT DOCUMENTS 6,419,788 B1 * 7/2002 Wingerson ..... D21C 1/02 127/37
2004/0025715 A1 * 2/2004 Bonde ..... A01C 3/00 99/485
(Continued)

FOREIGN PATENT DOCUMENTS

CN 1083143 3/1994
CN 102660885 A 9/2012
(Continued)

OTHER PUBLICATIONS

Pavlostathis et al., in "Alkaline Treatment of Wheat Straw for Increasing Anaerobic Biodegradability," Biothechnology and Bioengineering, vol. 27, pp. 334-344. (Year: 1985).*
(Continued)

*Primary Examiner* — Jose A Fortuna
(74) *Attorney, Agent, or Firm* — Morse, Barnes-Brown & Pendleton, P.C.; Stanley F. Chalvire, Esq.

(57) ABSTRACT

Described herein is a method for processing straw into an intermediate straw product. The method comprises: (a) treating straw with an alkaline solution having a p H of between about 10 and about 14, at a temperature of between about 20° C. and about 80° C., for a period of between about 6 hours and about 30 hours; (b) separating excess alkaline solution and the treated straw from each other; and (c) maintaining the treated straw in an anaerobic environment at a temperature of between about 30° C. and about 45° C., for a period of between about 6 hours and about 30 hours to produce an intermediate straw product. Also described is an
(Continued)

intermediate product produced by the method; a method for extracting lignin from straw; lignin thereby produced; a method for extracting cellulose fibers from straw to produce paper pulp; cellulose fibers and paper pulp thereby produced; a method for producing a paper pulp product or a paper product; a product thereby produced; and a container and apparatus for processing straw according to the methods described.

20 Claims, 1 Drawing Sheet

(51) Int. Cl.

| | |
|---|---|
| ***D21H 11/12*** | (2006.01) |
| ***D21C 7/06*** | (2006.01) |
| ***D21C 7/08*** | (2006.01) |
| ***D21C 7/10*** | (2006.01) |
| ***D21C 11/04*** | (2006.01) |
| ***D21C 11/00*** | (2006.01) |

(52) U.S. Cl.
CPC ..... *D21C 7/10* (2013.01); *D21C 11/0007* (2013.01); *D21C 11/04* (2013.01); *D21H 11/12* (2013.01)

(56) References Cited

U.S. PATENT DOCUMENTS

| | | | | |
|---|---|---|---|---|
| 2005/0051287 | A1 | 3/2005 | Chute et al. | |
| 2009/0053770 | A1 | 2/2009 | Hennessey et al. | |
| 2012/0325421 | A1* | 12/2012 | Li | C05F 7/02 162/189 |
| 2017/0159237 | A1* | 6/2017 | Buschmann | D21C 9/166 |
| 2017/0306556 | A1* | 10/2017 | Nafici | D21C 1/06 |

FOREIGN PATENT DOCUMENTS

| | | | | | |
|---|---|---|---|---|---|
| CN | 103757060 | A | | 4/2014 | |
| GB | 2090514 | | | 7/1982 | |
| GB | 2530987 | A | * | 4/2016 | D21C 1/06 |
| WO | WO 2000/025600 | A1 | | 5/2000 | |
| WO | WO 2009/045654 | A2 | | 4/2009 | |
| WO | WO-2012153189 | A2 | * | 11/2012 | C12M 21/04 |
| WO | WO-2016051202 | A1 | * | 4/2016 | D21C 1/06 |

OTHER PUBLICATIONS

Croce et al. In Anaerobic digestion of straw and corn stover: The effect of biological process optimization and pre-treatment on total bio-methane yield and energy performance, Biotechnology Advances, vol. 34, pp. 1289-1304. (Year: 2016).*

Heiske et al., in "Improving Anaerobic Digestion of Wheat Straw by Plasma-Assisted Pretreatment," Journal of Atomic and Molecular Physics, vol. 2013, pp. 1-7. (Year: 2013).*

International Search Report for PCT/GB2015/052893, dated Jan. 5, 2016.

Search Report for GB1417488.2, dated Nov. 20, 2014.

* cited by examiner

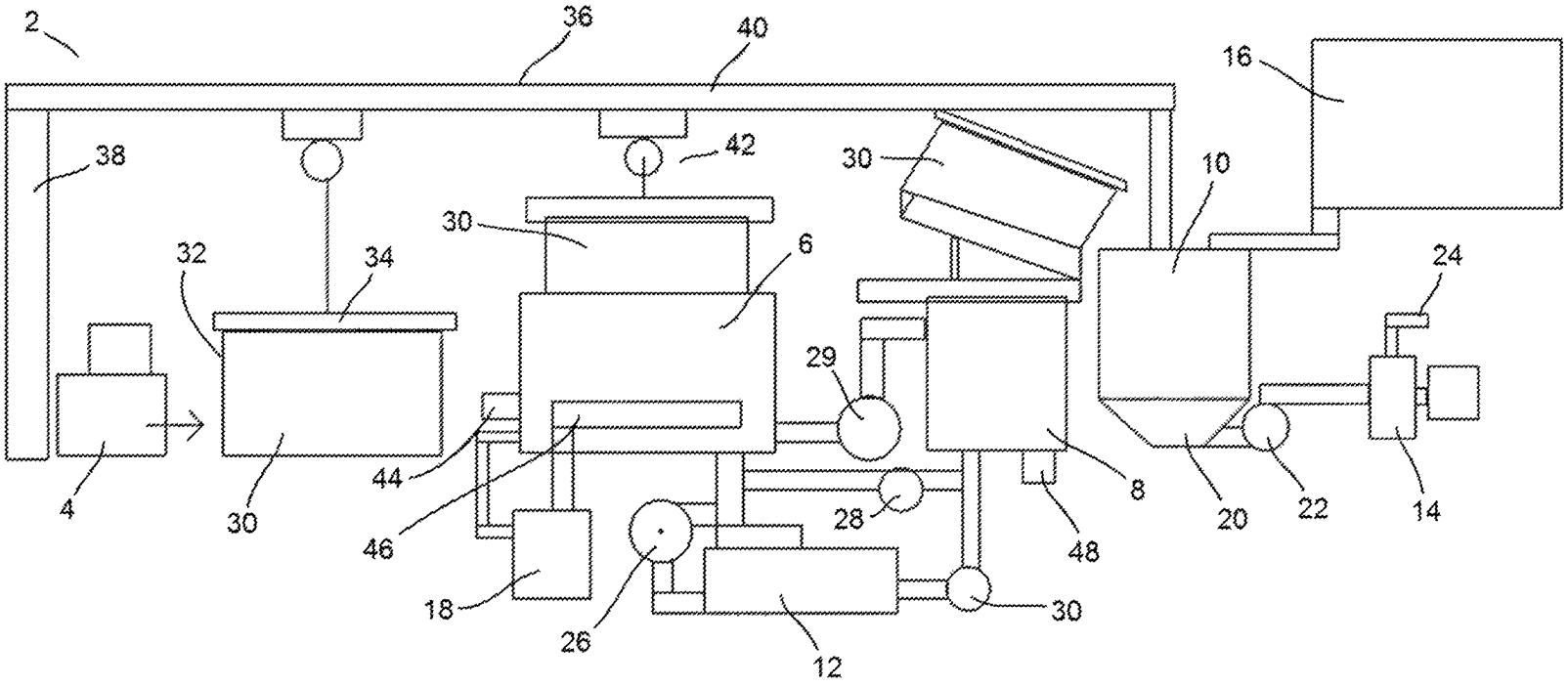
2
38
40
36
16
10
24
14
22
20
8
48
30
30
29
28
12
6
42
26
30
18
44
46
34
30
32
4

METHOD FOR PROCESSING STRAW

This application is a national stage filing under 35 U.S.C. 371 of International Application No.: PCT/GB2015/052893 filed on Oct. 2, 2015, which claims the benefit of GB Application No. 1417488.2 filed on Oct. 3, 2014. The entire teachings of International Application No. PCT/GB2015/052893 is incorporated herein by reference. International Application No. PCT/GB2015/052893 was published under PCT Article 21(2) in English.

This invention relates to a method for processing straw, in particular to a method for processing straw into a useful intermediate which can be further processed and/or refined into one or more useful end products, for example cellulose fibres useful for paper production. The straw may, in particular, be from wheat, barley, oats, rice or hay.

It is well known to extract cellulose fibres from straw to produce paper pulp and the paper pulp may be used in a wide variety of paper products. However, known processes for extracting cellulose fibres from straw are complicated and expensive, often relying on the use of pressure and/or substantial temperatures.

It is, therefore, an object of the present invention to seek to alleviate the above identified problems.

SUMMARY OF THE INVENTION

According to one aspect of the present invention, there is provided a method for processing straw into an intermediate straw product, the method comprising:

(a) treating straw with an alkaline solution having a pH of between about 10 and about 14, at a temperature of between about 20° C. and about 80° C., for a period of between about 6 hours and about 30 hours;

(b) separating excess alkaline solution and the treated straw from each other; and (c) maintaining the treated straw in an anaerobic environment at a temperature of between about 30° C. and about 45° C., for a period of between about 6 hours and about 30 hours to produce an intermediate straw product.

Remarkably, the method of the present invention results in an intermediate product which can be further processed to produce one or more end products, without subjecting the intermediate product to high pressures.

Whilst further processing of the intermediate straw product may comprise known steps, for example the use of pulping to produce a pulp and further processing steps to refine the pulp into paper pulp, the method of the present invention results in an intermediate product which enables much easier and more efficient further processing than would otherwise be possible.

It will be appreciated that reference to "excess alkaline solution" means alkaline solution not absorbed by the straw during step (a).

Preferably, step (b) comprises removing excess alkaline solution. Alternatively, step (b) comprises removing treated straw from the excess alkaline solution.

Preferably, steps (a), (b) and/or (c) are performed in a container, for example a tank, preferably a biotank.

Preferably, steps (a), (b) and (c) are performed in a single container, for example a tank, preferably a biotank.

Preferably, step (a) comprises placing untreated straw into the container and adding the alkaline solution to the straw from an inlet positioned above the straw.

Alternatively, step (a) comprises filling the container with alkaline solution and placing the untreated straw into the alkaline solution.

Preferably, the container is filled with alkaline solution to a predetermined level.

Preferably, step (a) comprises maintaining the level of alkaline solution at a pre-determined level within the container. For example, it will be appreciated that in a preferred embodiment, alkaline solution may be added to the container during step (a) to maintain the level of alkaline solution at a predetermined level.

Preferably, step (b) comprises draining alkaline solution from the container. Preferably, alkaline solution is drained from an outlet positioned towards or at the base of the container.

Preferably, the straw is treated in a first container and the alkaline solution is added from a second container.

Remarkably, the alkaline solution which is removed during step (b) has been found to contain much higher levels of lignin than would be expected.

Preferably, before (c) the method comprises removing air, for example from the container, to produce an anaerobic environment.

In another aspect of the present invention, there is provided a method for extracting lignin from straw, the method comprising processing straw into an intermediate straw product according to a method as described herein, and extracting lignin.

Preferably, lignin is extracted from the excess alkaline solution.

In another aspect of the present invention, there is provided a method for extracting cellulose fibres from straw to produce paper pulp, the method comprising (i) processing straw into an intermediate straw product as described herein; and (ii) further processing the intermediate straw product into paper pulp.

Preferably, the method comprises, (d) mixing the intermediate straw product with water and pulping the straw and water mixture;

(e) processing the pulped straw to obtain cellulose fibres from the straw; and (f) obtaining the pulp.

Preferably, step (d) comprises transferring the intermediate straw product to a pulper before mixing the intermediate straw product with water.

Preferably, step (d) comprises mixing the intermediate straw product with water in the pulper and pulping the straw and water mixture.

The process of the present invention is advantageous in that it allows cellulose fibres to be separated from straw with the use of low temperatures, and without the use of the pressure. Wastage of liquid is minimized since the process can be conducted using re-circulated liquid. The alkaline solution used can be inexpensive with a suitable example being caustic soda (sodium hydroxide). Thus cellulose fibres can be obtained in a simple and economically effective manner, and by a process which is environmentally friendly. The obtained pulp can be used in a wide variety of industries. Thus, for example, the pulp may be used in the paper industry for producing newspapers or other products. The obtained pulp may be used without further cleaning to produce, for example, egg boxes, bottle separators, and moulded fibre packaging products including containers. The pulp may be used with further cleaning to produce other paper products, for example paper tissues.

Preferably, step (e) comprises one or more, preferably all, of the following sub-steps:

(e1) filtering the pulped straw through a filter to extract cellulose fibres from the straw;

(e2) refining the filtered pulp straw in a refiner to extract further cellulose fibres from the straw;

(e3) screening the refined pulp to separate lignin and/or ash from the cellulose fibres;

(e4) washing the screened pulp with water to separate more lignin and/or ash; and (e5) returning liquid from step (e2) for re-use in the methods described herein.

Alternatively, or in addition, step (e) may comprise processing the pulped straw by de-flaking.

The methods of the invention may include recovering lignin that has been separated from the cellulose fibres. The lignin can be further processed to remove silica and any other desired impurities.

The alkaline solution preferably comprises caustic soda. Other alkaline solutions may be used, for example, the alkaline solution may comprise sodium carbonate. The alkaline solution may alternatively comprise potassium hydroxide or potassium carbonate.

The pH at step (a) is preferably about 14.

The temperature at step (a) is preferably about 80° C.

The time period at step (a) is preferably about 12 hours.

Preferably, step (a) comprises one or more, preferably all, of the following sub-steps:

(a1) placing the straw in a first container;

(a2) mixing water and an alkali in a second container to produce an alkaline solution having a pH of between about 10 and about 14;

(a3) heating the solution in the second container to a temperature of between about 20° C. and about 80° C.;

(a4) transferring the heated solution from the second container to the first container;

(a5) leaving the solution in the first container with the straw for a time period of between about 6 and about 30 hours at a temperature of between about 20° C. and about 80° C. during which time period some of the solution is absorbed by the straw; and (a6) transferring the remaining solution in the first container to the second container.

Preferably, the pH at step (a2) is about 14.

Preferably, the temperature at step (a3) is about 80° C.

Preferably, the temperature at step (a5) is about 80° C.

Other temperatures and time periods may be employed.

Preferably, step (a) comprises checking the level of the alkaline solution and/or the pH of the alkaline solution at repeated checking intervals, preferably for an initial time period.

Preferably, the level of the alkaline solution is checked to ensure that the straw stays covered. The level of the alkaline solution is checked because the straw absorbs the alkaline solution, and the straw should preferably not absorb so much of the alkaline solution that the alkaline solution level falls below the straw level.

The checking intervals are preferably about every thirty minutes. The checking intervals may be longer or shorter if desired.

The initial time period during which the repeated checking is conducted is preferably about the first four hours. This time period may be shorter or longer if desired.

Preferably, substantially all of the alkaline solution which has not been absorbed by the straw is transferred to the or a second container. For example, the transferred alkaline solution may be about 70% of the initially provided alkaline solution. In this case, about 30% of the initially provided alkaline solution will have been absorbed by the straw. The transferred alkaline solution may be more or less than the 70% of the initially provided alkaline solution, with the amount absorbed by the straw being the balance to 100%.

Step (a) may be such that preparation of the alkaline solution, immersion of the straw, and heating are all conducted in the first container. If just the first container is used, then the alkaline solution is preferably heated to the required temperature before straw is introduced into the container. In this case, the straw should preferably be introduced into the container such that the alkaline solution does not escape from the container.

Preferably, the temperature at step (c) is about 35° C.

Preferably, the time period at step (c) is about 12 hours.

Preferably, the straw and water mixture is pulped for a time period of between about 10 and about 20 minutes, preferably for about 15 minutes. Pulping for longer than 20 minutes may be employed if desired.

Preferably, pulped straw is filtered through a mesh filter. Preferably, the mesh filter comprises a 6 mm mesh filter. In other embodiments, larger or smaller mesh filters may be employed. Filters other than mesh filters may be employed.

Preferably, the filtering extracts the majority of the cellulose fibres from the straw.

Preferably, the filtered, refined and/or deflaked pulped straw, for example at step (e2), has a pH of between about 9 and about 10.

Preferably, the pulped straw is refined with a double-disk refiner. Other refining apparatus may be employed. The refining at step (e2) is effective to obtain further cellulose fibres from the straw, thereby giving a better yield than would otherwise be the case without the refining.

Preferably, transfer of liquids (alkaline solution and/or water) in the steps of the present invention is by means of one or more pumps.

Preferably, the straw is placed in a holder prior to step (a). Preferably, the holder is a cage. Other types of holder may be employed. The holder is preferably arranged to be movable between a plurality of positions to allow for the straw to be immersed in the alkaline solution, and then transferred to a pulper tank.

In one aspect of the present invention, there is provided a method for extracting lignin from straw, the method comprising a method for processing straw or a method for extracting cellulose from straw, as described herein.

Preferably, the method for extracting lignin comprises obtaining lignin from liquid which has been used to treat, process and/or wash the straw, the intermediate straw product, and/or a product produced therefrom.

According to another aspect of the present invention, there is provided an intermediate product produced by a method described herein.

According to another aspect of the present invention, there is provided cellulose fibres produced by a method described herein.

According to another aspect of the present invention, there is provided lignin produced by a method described herein.

According to another aspect of the present invention, there is provided paper pulp produced by a method described herein.

According to another aspect of the present invention, there is provided a method for producing a paper pulp product or a paper product, the method comprising obtaining paper pulp according to a method described herein and further processing the paper pulp into one or more paper pulp products or paper products.

Preferably, the one or more paper pulp products comprise egg boxes, bottle separators and moulded fibre packaging products.

Preferably, the one or more paper products comprise paper, cardboard, newspapers and tissue paper.

According to another aspect of the present invention, there is provided a paper pulp product produced by a method described herein.

According to another aspect of the present invention, there is provided a paper product produced by a method described herein.

According to another aspect of the present invention, there is provided a container for processing straw according to a method described herein.

Preferably, the container comprises (i) an inlet for introducing alkaline solution into the container, (ii) a first outlet for removing excess alkaline solution from the container, (iii) a second outlet for removing air from the container, and (iv) a heater for heating alkaline solution in the container.

Preferably, the container further comprises a level indicator for indicating the level of alkaline solution in the container.

According to another aspect of the present invention, there is provided an apparatus for processing straw according to a method described herein, wherein the apparatus comprises (i) a container as described herein, and (ii) a holder for holding straw and immersing the straw in liquid held within the container.

Preferably, the holder comprises a cage.

Preferably, the apparatus comprises (a) a first container as described herein, and (b) a second container, said second container comprising an outlet connected to the inlet of the first container for the transfer of liquid from the second container to the first container, and an inlet connected to the first outlet of the first container for the transfer of liquid from the first container to the second container.

Preferably, the second container comprises a heater for heating a liquid container therein.

Preferably, the apparatus is configured for allowing movement of the holder between two or more of the first container, the second container and/or the pulper.

Within this specification embodiments have been described in a way which enables a clear and concise specification to be written, but it is intended and will be appreciated that embodiments may be variously combined or separated without parting from the invention.

DETAILED DESCRIPTION

Embodiments of the invention will now be described solely by way of example and with reference to the accompanying FIGURE which shows apparatus for carrying out the process of the present invention.

Within this specification, the term "about" means plus or minus 20%, more preferably plus or minus 10%, even more preferably plus or minus 5%, most preferably plus or minus 2%.

Within this specification, the term "straw" means any cellulose-containing plant material capable of being used for producing paper pulp, preferably which is "straw-like".

Preferably, the term "straw" means the stalks of cellulose-containing plants, for example cereal plants, capable of being used for producing paper pulp.

Specific examples of the term "straw" include wheat, barley, oats, rye, rice, hay.

With reference to FIG. 1, there is shown apparatus 2 for carrying out a process for extracting cellulose fibres from straw 4 to produce paper pulp. The process comprises the following steps:

(a) immersing the straw 4 in a first tank 6 in an alkaline solution having a pH of 10-14 and a temperature of 20-80° C. for a period of 6-30 hours;

(b) removing excess alkaline solution;

(c) removing air from the first tank 6 to provide an anaerobic environment in the first tank 6 and maintaining a temperature of 30-45° C. in the first tank 6 for a time period of 6-30 hours to produce an intermediate straw product;

(d) transferring the intermediate straw product from the first tank 6 to a pulper tank 10 and mixing water with the intermediate straw product in the pulper tank 10 and pulping the straw and water mixture;

(e) processing the pulped straw to obtain cellulose fibres from the straw; and (f) obtaining the pulp.

In preferred embodiments, alkaline solution is added to the container during step (a) to maintain the level of alkaline solution at a predetermined level.

Step (e) may comprise the following sub-steps:

(e1) filtering the pulped straw through a filter 12 to obtain cellulose fibres from the straw;

(e2) refining the filtered straw in a refiner 14 to cause the cellulose fibres in the pulp to separate from each other and thereby obtain further cellulose fibres from the straw;

(e3) screening the refined pulp to separate lignin and ash from the cellulose fibres;

(e4) washing the screened pulp with water to separate more lignin and ash; and (e5) returning liquid from step (e2) for re-use in the process.

Alternatively, or in addition, step (e), for example step (e2), may be one in which the pulped straw is processed by de-flaking.

Step (a) may comprise the following sub-steps:

(a1) placing the straw in the first tank 6;

(a2) mixing water and an alkaline in a second tank 8 to produce an alkaline solution having the pH of 10-14;

(a3) heating the solution in the second tank 8 to 20-80° C.;

(a4) transferring the heated solution from the second tank 8 to the first tank 6;

(a5) leaving the solution in the first tank 6 in contact with the straw for a time period of 6-30 hours at a temperature of 20-80° C. during which time period some of the solution is absorbed by the straw; and (a6) transferring the remaining solution in the first tank 6 to the second tank 8.

The water for mixing with the straw at step (e) is provided from a water tank 16.

The liquid in the first tank 6 is heated by a heater 18.

The liquid in the second tank 8 may be heated by a heater (not shown) before being transferred to the first tank 6.

The pulper tank 10 has a frusto-conical bottom portion 20 in which some ash/sand is removed.

The pulped straw is pumped by a pump 22 to the refiner 14. Paper pulp exits the refiner 14 via an outlet 24. Liquid pumps 26, 28, 30 are provided as shown and in contact with the filter 12 in which the lignin is separated. A vacuum pump 29 provides the required anaerobic conditions in the first tank 6 for the step (c) of the process.

The process described above with reference to the apparatus 2 is conducted such that the alkali is caustic soda (sodium hydroxide), the pH at step (a2) is 14, the temperature at step (a3) is 80° C., the time period at step (a5) is 12 hours, and the temperature at step (a5) is 80° C.

The step (a5) in the process is conducted with repeated checking intervals for initial time period. This initial checking is for checking the level of the liquid in the first tank 6 to ensure that the straw 4 stays covered. This is necessary because the straw 4 absorbs liquid. The initial checking is also for checking the pH of the liquid in the first tank 6. The checking intervals are every 30 minutes, with the initial time period being the first 4 hours.

Step (a6) is such that the transferred liquid is substantially all of the liquid which has not been absorbed by the straw 4. This transferred liquid is approximately 70% of the initially provided liquid. Approximately 30% of the initially provided liquid will have been absorbed by the straw. This transferred liquid is approximately 70% of the initially provided liquid. Approximately 30% of the initially provided liquid will have been absorbed by the straw.

The temperature at step (c) is 35° C., and the time period at step (c) is 12 hours.

The pulping at step (d) is for a time period of 10-20 minutes, and more preferably is 15 minutes.

The filtering at step (e1) is through a mesh filter. The mesh filter is a 6 mm mesh filter.

The filtered pulp at step (e2) is at a pH of 9-10. The filtered pulp at step (e2) is refined with a refiner 14 which is a double-disc refiner 14.

The straw 4 is placed in a holder 30 prior to step (a1). The holder 30 is a cage having mesh sides 32. The holder 30 has a solid lid 34 as shown.

The apparatus 2 includes a transport framework 36. The transport frame work 36 is shown schematically as having an upright 38 and a horizontal top rail 40. A transfer arrangement 42 is able to transfer the holder 30 when it has been loaded with the straw 4 to the first tank 6 as shown, and then to the second tank 8. When the holder 30 is above the second tank 8, its lid 34 is removed as shown in order to tip the straw 4 with its water content into the pulper tank 10. The transfer arrangement 42 thus enables the holder 30 to be movable between a plurality of positions to allow for the straw filling, the immersion in the first tank 6, the removal from the first tank 6, and the transfer to the pulper tank 10.

The pulper tank 10 acts as an extraction tank. The pulper tank 10 has a pulper (not shown) for pulping the straw and water mixture. The pulper may act as a mixture device. The pulper may be such that it uses a blade for effecting the pulping/mixing.

A filter (not shown) in the bottom portion 20 of the third tank 10 filters the pulped straw. Known pulpers used in the paper industry are able to be used to effect the required pulping, mixing and filtering.

As shown in FIG. 1, the pH control for the first tank 6 is controlled by a pH controller 44. The heater 18 connects to a radiator 46 inside the first tank 6. The pH control for this second tank 8 is controlled by a pH controller 48.

The process of the present invention is advantageous in that the lignin can be physically separated from the water using the filter 12, which may be a filter press. The cellulose fibres are extracted at low temperatures, and without using any pressure. Still further, as can be seen from FIG. 1, the first tank 6, the second tank 8 and the pulper tank 10 are connected by conduits so that the liquid can be re-circulated. The liquid containing the lignin is usually black but once the liquid has been filtered, the liquid can be re-circulated in the illustrated closed loop conduit system. The colour of the water is brown when the lignin has been removed. In comparison with known processes, the process of the present invention may take more time; however, it is more economical because it uses low temperatures and does not require pressure. Also, advantageously, the separated lignin can be recovered more easily than in known processes and then used for making lignin-based and/or containing products, for example as a filler in certain plastics.

Step (a) may be conducted solely in the first tank 6. Thus the first tank 6 may be used for preparing the alkaline solution, and then subsequently adding the straw. In this case, the immersion of the straw should be such as to ensure that alkaline solution is not lost from the first tank 6 whilst the holder 30 with the straw 4 is lowered into the first tank 6.

The various tanks, containers and holders employed in the apparatus 2 are preferably made of stainless steel but they may be made of other suitable and appropriate materials if desired. The pulp obtained from the outlet 24 may be further processed using existing known technologies prior to being used as pulp for the production of the paper products. Alternatively, the pulp direct from the outlet 24 can be used for the production of the paper products. The pulp may be used in the paper industry other than for producing newspapers so that, for example, the pulp may be used for providing paper tissues, paper hand towels, toilet rolls, cardboard, cardboard packaging and other paper articles.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications are covered by the appended claims.

What is claimed is:

1. A method for processing straw into an intermediate straw product, the method comprising:

(a) treating straw with an alkaline solution having a pH of between about 10 and about 14, at a temperature of between about 20° C. and about 80° C., for a period of between about 6 hours and about 30 hours;

(b) separating excess alkaline solution and the treated straw from each other; and (c) maintaining the treated straw in an anaerobic environment at a temperature of between about 30° C. and about 45° C., for a period of between about 6 hours and about 30 hours to produce an intermediate straw product into which some of the solution has been absorbed.

2. A method according to claim 1, wherein the intermediate straw product is further processed and/or refined into cellulose fibres useful for paper production.

3. A method according to claim 1, wherein before step (c) the method comprises removing air to produce an anaerobic environment.

4. A method according to claim 1, which comprises further processing the intermediate straw product into paper pulp.

5. A method according to claim 4, which comprises, (d) mixing the intermediate straw product with water and pulping the straw and water mixture;

(e) processing the pulped straw to obtain cellulose fibres from the straw; and (f) obtaining a straw fibres pulp.

6. A method according to claim 5, wherein step (e) comprises the following sub-steps:

(e1) filtering the pulped straw through a filter to extract cellulose fibres from the straw;

(e2) refining the filtered pulp straw in a refiner to extract further cellulose fibres from the straw;

(e3) screening the refined pulp to separate lignin and/or ash from the cellulose fibres;

(e4) washing the screened pulp with water to separate more lignin and/or ash; and (e5) returning liquid from step (e2) for re-use in any preceding step.

7. A method according to claim 5, wherein step (e) comprises processing the pulped straw by de-flaking.

8. A method according to claim 4, which comprises recovering lignin that has been separated from the cellulose fibres.

9. A method according to claim 1, wherein the alkaline solution comprises caustic soda.

10. A method according to claim 1, wherein the alkaline solution comprises an alkali selected from the group consisting of sodium carbonate, potassium hydroxide and potassium carbonate.

11. A method according to claim 1, wherein the pH at step (a) is about 14.

12. A method according to claim 1, wherein the temperature at step (a) is about 80° C.

13. A method according to claim 1, wherein the time period at step (a) is about 12 hours.

14. A method according to claim 1, wherein step (a) comprises the following sub-steps:

(a1) placing the straw in a first container;

(a2) mixing water and an alkali in a second container to produce an alkaline solution having a pH of between about 10 and about 14;

(a3) heating the solution in the second container to a temperature of between about 20° C. and about 80° C.;

(a4) transferring the heated solution from the second container to the first container;

(a5) leaving the solution in the first container with the straw for a time period of between about 6 and about 30 hours at a temperature of between about 20° C. and about 80° C. during which time period some of the solution is absorbed by the straw; and (a6) transferring the remaining solution in the first container to the second container.

15. A method according to claim 1, wherein the temperature at step (c) is about 35° C.

16. A method according to claim 1, wherein the time period at step (c) is about 12 hours.

17. A method according to claim 1, wherein the straw is placed in a holder prior to step (a).

18. A method according to claim 17, wherein the holder is arranged to be movable between a plurality of positions to allow for the straw to be immersed in the alkaline solution, and then transferred to a pulper tank.

19. A method for processing straw, the method comprising:

(a) treating straw with an alkaline solution having a pH of between about 10 and about 14, at a temperature of between about 20° C. and about 80° C., for a period of between about 6 hours and about 30 hours;

(b) separating excess alkaline solution and the treated straw from each other; and (c) maintaining the treated straw in an anaerobic environment at a temperature of between about 30° C. and about 45° C., for a period of between about 6 hours and about 30 hours.

20. A method according to claim 19, the method further comprising:

(d) mixing the treated straw with water and pulping the treated straw and water mixture to produce pulped straw;

(e) processing the pulped straw to obtain cellulose fibres from the straw; and (f) obtaining a straw fibres pulp.

* * * * *